US008284074B2

(12) United States Patent
Orban et al.

(10) Patent No.: US 8,284,074 B2
(45) Date of Patent: Oct. 9, 2012

(54) METHOD OF DETERMINATION OF A STUCK POINT IN DRILL PIPES BY MEASURING THE MAGNETIC PERMEABILITY OF PIPES

(75) Inventors: Jacques Orban, Moscow (RU); Mikhail Iakimov, Berdsk (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 1364 days.

(21) Appl. No.: 11/839,060

(22) Filed: Aug. 15, 2007

(65) Prior Publication Data

US 2008/0042870 A1 Feb. 21, 2008

(30) Foreign Application Priority Data

Aug. 15, 2006 (RU) ..... 2006129375

(51) Int. Cl.
*G01V 3/00* (2006.01)

(52) U.S. Cl. ..... 340/854.2; 340/853.1; 340/854.1; 166/250.13

(58) Field of Classification Search ..... 340/854.2, 340/853.1, 854.1; 367/35, 81, 82; 166/244.1, 166/250.01, 250.13
See application file for complete search history.

(56) References Cited

U.S. PATENT DOCUMENTS

| | | | | |
|---|---|---|---|---|
| 2,250,703 | A * | 7/1941 | Crites et al. | 324/346 |
| 4,708,204 | A * | 11/1987 | Stroud | 166/255.1 |
| 5,520,245 | A * | 5/1996 | Estes | 166/66 |
| 7,207,396 | B2 | 4/2007 | Hall et al. | |
| 7,246,663 | B2 | 7/2007 | Rose | |
| 7,389,183 | B2 * | 6/2008 | Gray | 702/6 |
| 2005/0240351 | A1 * | 10/2005 | Gray | 702/6 |

FOREIGN PATENT DOCUMENTS

| | | |
|---|---|---|
| SU | 142242 | 1/1961 |
| SU | 600287 | 3/1978 |
| SU | 1420148 | 8/1988 |

* cited by examiner

*Primary Examiner* — George Bugg
*Assistant Examiner* — Franklin Balseca
(74) *Attorney, Agent, or Firm* — Jeremy Berman

(57) ABSTRACT

The invention is a method of determining a free point in stuck drill pipes, comprising the steps of:

a. measuring a first magnetic permeability ($\mu_1$) based on a time-induced decay of the electromagnetic field generated by application of an electric current pulse to the unextended pipe ($l_0$);
b. applying a force to the pipe to extend the pipe ($l_1$);
c. measuring a second magnetic permeability ($\mu_2$) of the extended pipe ($l_1$); and
d. comparing the first and second magnetic permeabilities ($\mu_1$ and $\mu_2$) along the drill string to determine the free point based on the change of magnetic permeability.

13 Claims, 4 Drawing Sheets

PRIOR ART

PRIOR ART

PRIOR ART

METHOD OF DETERMINATION OF A STUCK POINT IN DRILL PIPES BY MEASURING THE MAGNETIC PERMEABILITY OF PIPES

TECHNICAL FIELD

The invention relates to the oil drilling industry, and in particular, to surveying boreholes, and the determination of free or stuck parts of pipes in a borehole.

BACKGROUND ART

Drill pipes often get stuck in the hole during the drilling process carried out oil and gas drilling operations. The main reasons of this undesirable situation are as follows:

- insufficient drilling mud circulation, which results in accumulation of sludge in the hole;
- insufficient drilling mud weight, which results in caving;
- excess drilling mud weight, which results in sticking;
- peculiarities of rock lithology (e.g. water-sensitive clays which swell in the presence of water);
- peculiarities of rock structure (e.g. some sedimentary rock may form long narrow lenses);
- tangential tectonic stresses, which results in caving; improper drilling mud composition, which results in inefficient or easily peelable mud cake;
- various faults of the drilling rig, derrick and underwater equipment, which results in long interruptions of pipe rotation, drilling mud movement or circulation;
- various faults of the pipe string; and
- human factors.

Pipe recovery is always unwanted but is frequently a necessary operation in the drilling. If a tubular (such as drillpipe, heavy weight drillpipe, drill collar, stabilizer joint, production tubing, casing, or liner) becomes stuck in the borehole and cannot be retrieved by activating downhole jar devices, applying pull or torque from surface, or adjusting mud circulation, the usual practice is to disconnect the free part above the stuck point (by means of various mechanical, explosive or chemical devices), and retrieve the free portion of the tubular string from the well. Upon the retrieval, remedial actions can be applied to the remaining portion of the string.

Since pipe sticking contributes to down time during drilling, it is important to resolve this problem quickly. Pipes get stuck in almost a third of drill holes at the preliminary drilling (so-called exploration drilling) stage.

If standard stuck-pipe releasing measures such as activation of drilling jars, increased drilling mud circulation, changes in the drilling mud weight, etc. prove to be inefficient, a remedial pipe recovery procedure is started. The typical pipe recovery sequence is as follows:

1. Determination of the most likely location of the "free point" 1, i.e. the lowest pipe string section which is still free; see FIG. 1. FIG. 1 shows a stuck pipe 2 in a borehole 3 below the derrick floor level 4 with a wireline tool 5 in the pipe 2.
2. Resumption of drilling mud circulation: in some cases, it is recommended that the pipe below the free point should be perforated and that the drilling mud circulation should be resumed from this point upwards. A strong drilling mud flow can displace the obstacle upwards.
3. Pulling of free pipe: the pipe above the free point is separated from the stuck bottom part and can be pulled out to the surface. Many sophisticated mechanical, explosive and chemical aids are used for separation of the pipe string.
4. After the free pipe has been pulled out, fishing operations are commenced to retrieve the remaining part of the pipe string and to pull it from the hole; see FIG. 2 for various typical rig-up tools used. In case of a reliable fish, the sequence returns to step 1. described above, but the drilling connection now includes additional drilling jars, a fishing slip to be used for fishing the remaining part, and a safety joint for quick disconnection in case of further troubles.
5. If the fishing operations are successful, the drilling process continues as usual. If the fishing operations fail, the driller will have an option either to drill a side hole to bypass the remaining part of the string or to abandon the whole borehole. It is important to understand that, without performing the pipe pulling operation (according to 2 above), it is impossible to eliminate the emergency by bypassing the remaining part of the string via the second hole or to abandon the borehole in a safe and environmentally appropriate way.

It is important to have a good estimation of the bottom-most free point in the tubular string. Performing retrieval from too far above this free point results in loss of useful borehole space and in unnecessary loss of expensive tubulars. Cutting the tubular string below the free point obviously results in no retrieval at all and severely complicates any possible remedial actions.

As shown above, the free point detection procedure is important for successful accomplishment of the pipe-pulling operation and can even be used several times during the same attempt to pull the pipe. Emergency pulling of a string part is one of the most dangerous operations on the derrick and has the potential to cause injuries and even death of the personnel.

Presently, there are three conventional methods of determination of the free point.

1 Determination of the Free Point, Based on Measurements of Pipe Extension from the Surface.

First, the buoyancy of the drill pipe should be determined. This buoyant force can be calculated, using special tables based on the specific gravity of the drilling mud, type and length of the drilling pipe. The calculations are checked, using a weight indicator on the hook suspending the drill pipe, by comparing the calculated buoyant force with average hook readings, while moving the pipe up and down until equilibrium has been determined (the averaging of these measurements reduces the impact of errors on friction).

After the pipe has been placed in equilibrium, a chalk mark is made on the drill string at the derrick floor level. The driller slowly applies a tension force exceeding the buoyant force, i.e. by a specified value greater than the buoyant force, and the driller's assistant measures and records the pipe extension (i.e. the position of the chalk mark above the derrick floor level).

The stuck point is assessed, based on the linear pipe extension/tension force relationship. The shorter the pipe extension for a fixed drag force, the shallower the depth at which the free point is located. The drillers are accustomed to perform the tubular stretch measurements from the surface by applying different values of over-pull to the stuck tubular and performing stretch measurements of the tubular at the rig floor.

Tables of pipe extension coefficients and nomograms to be used for determination of the free point are published for most pipes. Recently, special software has been developed for laptops and palmtops to allow the performance of the same calculations even in cases that the drill string consists of different pipes.

The overall accuracy of this method is limited by the resolution of the weight indicators on the hook and by the general design of the traveling block and draw-works drums of the drilling rig. The measurements are also influenced by the friction between the drill pipes and the hole walls in deviated holes. Thus, surface determination of the stuck point is always performed but is almost always supplemented with and confirmed by other types of measurements which are described below.

Also, if the well is deviated and/or the stuck point is close to surface, such measurements become difficult, imprecise, or impossible.

2 Downhole Determination of the Free Point Based on Attachment of Stress and Torque Sensors.

Another conventional method is to use precise electromechanical stretch and torque sensors that can be attached to the inside of the tubular by means of remotely operated anchors. Pipe stretch and torque can be recorded, point-by-point, by such sondes whilst the stretch and torque is applied from the surface by the driller. If the sensor indicates any movement (stretch or torque), then the anchoring point is above the free point. If the sensor does not indicate any movement, then the anchoring point is below the free point.

Fixed stress and torque sensors have been used for development of cable measurement methods since the early 1960s. The latest example of such tools is a Free Point Indicator Tool™ (FPIT) developed by Schlumberger. The tool can be installed on a conventional 7-conductor logging cable.

The tool consists of two independent electromechanical anchor sections spaced 2 meters apart, and of a stress and torque precision sensor installed between them. Anchor motors can be enabled from the electronic module installed above the upper anchor. The same electronic module digitizes the sensor signals and sends them to the surface into a computer-aided measurement results management and gathering system.

FIG. 2 shows a typical drill floor setup for a wireline tool run into a stuck drill pipe. The drill pipe 20 is supported on the derrick (not shown) by means of a hook 22 and draw works including a running block 24. The wireline tool (not shown) is run inside the drill pipe 20 on a wireline cable 26 via an upper block 28 and a sheave (and cable odometer) 30. Measurements start from determination of equilibrium, as described above. Logging cable blocks are located on the derrick: the lower one is installed into standard position at the bottom and the upper one is fixed on the derrick structures. The upper block cannot be placed into standard position on the travelling block because this block is also used for application of a tension force to the pipes. The tool is then lowered into the stuck pipe string.

The driller applies a force equal to the buoyant force. The upper anchor is activated at a certain predetermined point at the command from the surface, and the tool is fixed on the pipe. Then, the cable tension is slackened so that accidental cable movement should not influence the measurement results. After that, the lower motor is activated.

First, it resets the sensor block by setting it into the slack and untwisted initial condition and then extends the lower anchor. After that, the driller slowly applies a tension force exceeding the buoyant force by a specified value, and the operator of the logging system reads the sensor. If the pipe is free at the anchor fixation point, the sensor registers axial movement of the upper anchor with respect to the lower anchor. Depending on the derrick design, the driller can then apply a torque to the drill pipe in specified increments with respect to the normal position, and the operator reads the sensor.

If the pipe is free at the point where the anchor is located, the sensor registers a turn of the upper anchor with respect to the lower anchor. After the measurement has been taken, the cable slack is taken up, the anchors (first the lower one, and then the upper one) fold up, and the tool can be moved to the next measurement point where the whole procedure is repeated.

Using this method, it is possible to determine the free point to a required degree of accuracy after 10-15 measurements. Limitations of this method are connected with the physics of measurements. The sensor must be very sensitive and must register weak relative movements of the anchors. So, the measurements are influenced by the cable friction inside the pipes and by the cable position on the derrick (especially if the cable is in contact with a part of the moving block 24). The measurements can further be influenced by anchor slips. If the inside diameter of the pipe exceeds 80 mm, the reliability of the measurements will be reduced due to the curvature of the anchor legs. The necessity of continuous pipe movement endangers the personnel on the derrick and measurements are taken very slowly. The measurements taken using a FPIT are considered to be "sensitive to the personnel qualification" and require the availability of an experienced logging operator.

3 Downhole Determination of the Free Point, Based on Magnetic Marks.

The third conventional method of free point estimation by wireline tool is to record magnetic marks from inside the tubular downhole and then apply stretch from surface. The position and the strength of the magnetic marks can be recorded. In the section of the tubular below the free point, both strength and the position of the marks remain unchanged, while in the portion above the free point, changes are observed.

The method of magnetic marks (Russian Inventor's Certificate 142242 E 21 B 23/09, 1961) is often used by field logging companies which developed from former USSR/CIS' enterprises, and this method has been known since the early 1960s.

The tool depicted in FIG. 3 consists of a diamagnetic shell 6 with a paramagnetic core 7 in the form of a coil. Electric winding 8 is wound on the coil in such a way as to form an open-core electromagnet. The sensitive part of this tool is manufactured in different diameters and, consequently, the slot between the pipe wall and the magnetic core is limited.

Measurements start from determination of equilibrium, as described above. The logging cable blocks are installed on the derrick: the lower one is installed into standard position at the bottom and the upper one is fixed on the derrick structures. According to another option, the upper block is placed into standard position on the traveling block. In this case, the tool can be temporarily pulled from the pipes as long as the traveling block is used for application of a tension force which is then maintained by using borehole wedges. Depending on the derrick design, this option can be much safer and faster as compared with the option in which the upper block is located on the stationary structure of the derrick.

The driller applies a force equal to the buoyant force. The logging tool is lowered to the bottom of the pipe to make the "marking pass". At a preliminary selected distance (the achievement of this distance is determined, using a cable odometer), heavy current is supplied to the coil, which results in magnetization of a narrow ring of the drill pipe wall. After that, the tool is lowered once more to make the "base pass". The coil is connected to the sensitive electronic block that measures electric tension in the coil and determines magnetization along the length of the pipe walls. Then, the coil is again lowered to the bottom, and the driller applies a drag force from the surface. The tool makes the "stretched pass" and records the level of magnetization of the pipe walls.

The data obtained from the "base pass" and the "stretched pass" are compared to draw a conclusion about the free point. The position and the intensity of magnetic marks will remain unchanged in the area below the free point. As far as the area above the free point is concerned, the distance between the magnetic marks will slightly increase and their intensity will decrease.

Limitations of this method are connected with the fact that the drill pipe must only be made of steel having a sufficient coercive force so that the pipe could retain magnetization. This method is not applicable to paramagnetic strings made of aluminum, stainless steel or Monel, for instance. The applicability of the method is adversely affected by the fact that the position of the mark is associated with the logging odometer readings, and the accuracy of determination of the distance between the magnetic marks is therefore inevitably limited by depth measurement errors and is connected with a well-known mathematical problem of "small difference of big numbers".

There is a known method (Russian Inventor's Certificate 600287 E 21 B 23/00, 1978) of determination of the stuck point of a drill pipe string. According to the known method, when determining the stuck point, drillers lower a stuck point detector, using a logging cable, into the stuck pipe string to reach the stuck point, and make a control record of changes in magnetic properties along the pipe string within the assumed stuck point range in the selected depth scale. The stuck point detector used during the implementation of the method contains a power point, a tool head, a non-magnetic protective shell and a cored coil, as well as a condenser, a diode and a gas-discharge lamp located in an insulating sleeve. The gas-discharge lamp is placed between the power point and the coil in parallel with the diode, and the condenser is placed in parallel with the coil and the gas-discharge lamp.

The disadvantage of the known method consists in the fact that the results of the stuck point determination greatly depend on the previous magnetization of the pipe and that it is impossible to use this method in paramagnetic strings.

There is also a known method (Russian Inventor's Certificate 1420148 E 21 B 47/09, 1988) of determination of the boundary of the stuck area of a drill pipe string in a hole. According to the known method, a stationary magnetic field corresponding to the maximum differential permeability of the string material is created in the specified area of the drill pipe. While the string is gradually and mechanically loaded, a Barkhausen effect occurs in the free area and is registered. The Barkhausen effect consists in occurrence of pulse electric current or tension in the chain of the inductance coil located near the surface of the ferromagnetic object. The boundary of the stuck area is determined by disappearance of the Barkhausen effect.

The disadvantages of the known method include low sensitivity of the method and potential false indication of a free string in case of a high coercive force of the string metal, as well as in the necessity to take stationary measurements, which extends considerably the work period.

In the following known method of determination of the stuck point of drill pipes (Russian Inventor's Certificate 142242 E 21 B 23/09, 1961), discrete magnetic marks are successively created on the drill pipe, using a magnetizing coil. Then, the curve of magnetic induction (magnetic field intensity) along the pipe string is recorded, using a magnetic modulation sensor. A certain mechanical (twisting or stretching) force which is not to exceed the ultimate strength of the pipe is applied to the stuck pipe, and a magnetic induction curve is recorded again. Due to elastic deformation of the free part of the drill pipe, the magnetic marks demagnetize on this part of the pipe but remain on the stuck part, which is clearly observed on the magnetic induction curve.

The disadvantages of the known method include its complexity resulting from the necessity to perform the operation of creation of discrete magnetic marks, as well as insufficient accuracy resulting from the discrete pattern of arrangement of the marks.

Thus, known downhole conventional systems have limitations. In case of the anchored tool, the measurements are affected by the cable motion while applying stretch or torque from the surface. The rig-up methods for such measurements are often complicated and dangerous to personnel involved. The magnetic mark method precision is limited by the wireline depth control system resolution and so this method is often insufficiently precise.

The object of the present invention determination of the free point in stuck drill pipes is to increase the reliability and to simplify the procedure of determination of the free point in a string.

Another object of the method developed is to reduce costs of emergency maintenance works due to a reduced work period, as well as due to accurate determination of the stuck point.

The invention is based on the recognition that the magnetic permeability of a metal varies under tension.

DISCLOSURE OF INVENTION

The first aspect of the present invention is a method of determining a free point in stuck drill pipes, comprising the steps of:

a. measuring a first magnetic permeability ($\mu_1$) based on a time-induced decay of the electromagnetic field generated by application of an electric current pulse to the pipe in a first tension state ($l_0$);
b. applying a force to the pipe to change the tension state of the pipe ($l_1$);
c. measuring a second magnetic permeability ($\mu_2$) of the extended pipe in a second tension state ($l_1$); and
d. comparing the first and second magnetic permeabilities ($\mu_1$ and $\mu_2$) along the drill string to determine the free point based on the change of magnetic permeability.

Preferably, the pipe is essentially unextended in the first tension state and is stretched in the second tension state.

Preferably, force is applied at the level of the derrick floor from which the drill pipes are suspended. The free point is determined by calculations based from Maxwell equations. Preferably, the force applied to the pipe is a twisting or stretching force. Preferably, a series of magnetic permeability measurements are made at different locations within the drill pipe.

Preferably, the method comprises applying a first electric current pulse to the pipe, measuring the first magnetic permeability, changing the tension state of the pipe, applying a second electric current pulse to the pipe and measuring the second magnetic permeability.

The second aspect of the present invention is an apparatus for determining a free point in stuck drill pipes comprising a diamagnetic shell containing a coaxially located exciting coil and two electromagnetic field measuring the devices, wherein two coaxial coils are located on either side of the exciting coil.

Preferably, the two coaxial coils are positioned on the top and bottom of the exciting coil respectively. Preferably, the pipe can be made from any paramagnetic or ferromagnetic material.

The third aspect of the present invention is a method using the apparatus mentioned above to determine a free point in stuck drill pipes, comprising the steps of:

1. lowering the apparatus to the bottom of the pipe and measuring the first pass of time-induced electromagnetic field decay along the full length of the pipe;
2. applying a force to a string;
3. lowering the apparatus to the bottom of the pipe and measuring the second pass of time-induced electromagnetic field decay along the full length of the pipe; and
4. determining the free point by comparing the first and second respective time-induced electromagnetic field decays to obtain a relative variation of magnetic permeability along the string.

The free point is determined because the magnetic permeability does not change substantially below the free point but changes above the free point. Preferably, a short square pulse of electric current is created in the exciting coil, preferably about 100 to 300 msec. Preferably, the string is a drill string or casing string.

BRIEF DESCRIPTION OF DRAWINGS

Other features and advantages of the present invention will become apparent in the following detailed description of the preferred embodiment with reference to the accommodating drawings, of which.

MODE(S) FOR CARRYING OUT THE INVENTION

The present invention performs the tubular stretch measurements by measuring specific magnetic permeability μ of the tubulars downhole. By the material experiments, it has been demonstrated that μ in steel is affected by the external stress. By measuring this property on the tubular before and after applying the stretch or torque from surface it is possible to determine the tubular free point; below this free point the magnetic permeability will remain unchanged. The system of the present invention combines the rig-up and operation simplicity of the magnetic mark tool, whilst providing sufficient precision of the free point estimation. Unlike the anchored tool, the method of the present invention does not require any moving parts that further simplifies the tool design and maintenance.

As an additional benefit, the same tool can be used for detection of the stress points in fixed tubulars, such as liner, casing, or production tubing strings, for the prediction of the premature failures of these tubulars.

Figure 4:
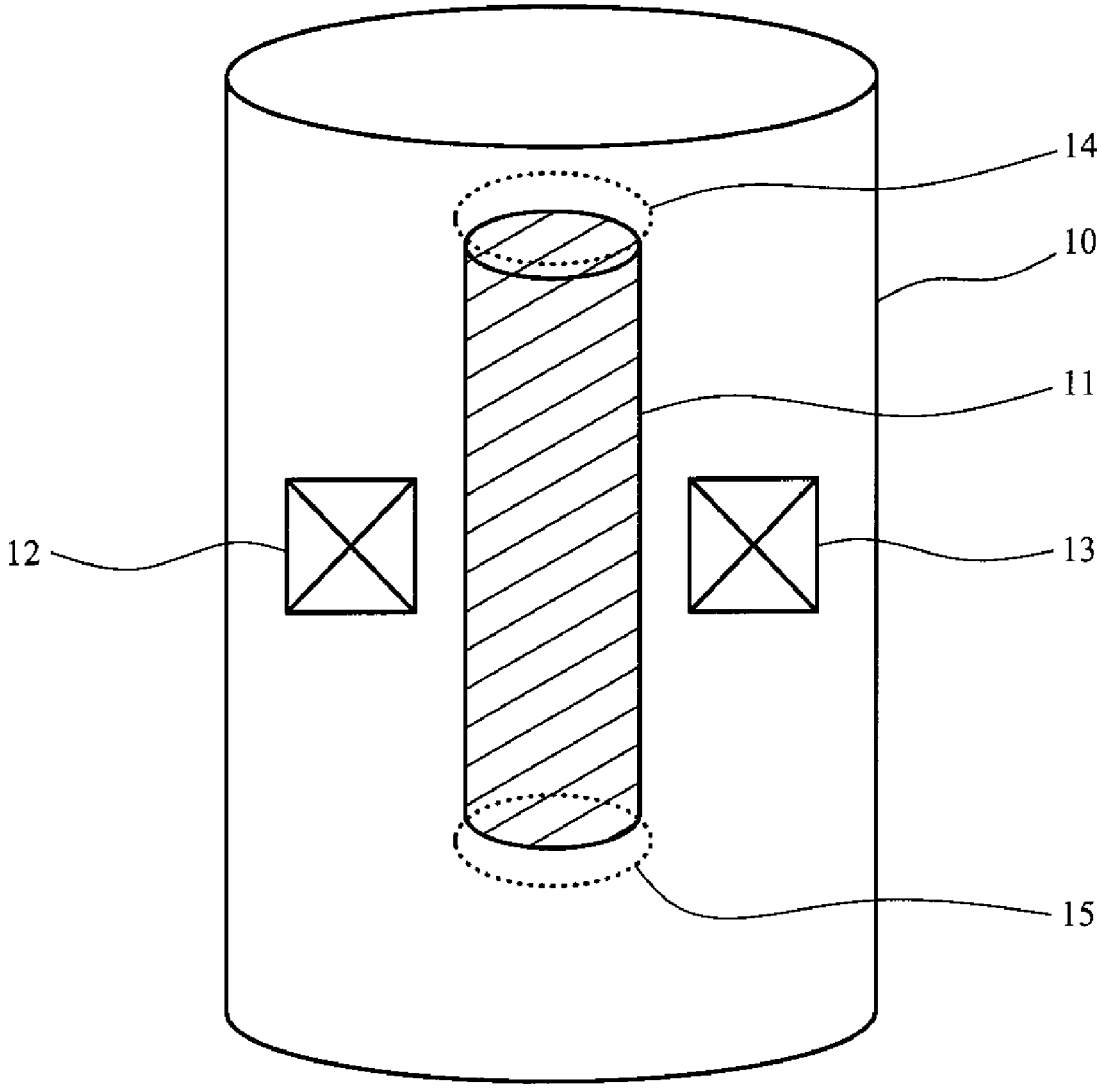
FIG. 4 is a schematic illustration of the apparatus used in the present invention.

During the implementation of this method, it is preferable to use an apparatus 1 as illustrated in FIG. 4 which comprises a diamagnetic shell 10 which contains a coaxially located exciting coil 11 and two electromagnetic field measuring devices 12, 13, and two coaxial coils 14, 15, located on each side of the exciting coil 11. The method of electromotive force measurement in receiving coils or in other electromagnetic field measuring devices is standard.

The method developed is based on the following physical phenomenon. If a short (~200 msec) square pulse of electric current is created in the exciting coil 11, the electromagnetic field outside the coil 11 will not disappear instantly after disappearance of the current. The electromagnetic field decay outside the coil 11 is described by a system of differential equations which can be derived directly from Maxwell's equations.

The method of the present invention is based on the property of magnetic permeability μ in paramagnetic and ferromagnetic materials being dependent on stress. After the stress state of the pipe has changed, the magnetic permeability of the material changes within a range sufficient for identification of the stuck point (a variation of about 9.5% within the allowable range of the string loading variation). Determination of the magnetic permeability by the transient method does not depend on premagnetization of the string material.

Mathematical simulation and the results of a full-scale experiment show that the electromagnetic field decay rate in the method of the present invention depends on the following four parameters: drill string inside diameter $r_1$, drill string outside diameter $r_2$, drill string conductivity σ and magnetic permeability μ. The parameters $r_1$ and $r_2$ are known to a good degree of accuracy. The parameters $r_1$, $r_2$ and σ remain substantially unchanged when the string is loaded (the variation does not exceed 0.07% within the allowable range of the string loading variation). Thus, a drastic change in the electromagnetic field decay value allows drillers to determine the free point, and two passes made by the apparatus of the present invention made in the string in unloaded and load conditions allow drillers to solve the system of the equations relative to the variation of the parameter μ along the full length of the string and, consequently, to determine the exact free point.

Determination of the string equilibrium is desirable but is not obligatory for applicability of the method of the present invention.

During the finalization of the method, it was experimentally proved that the measurable value μ is independent of premagnetization of steel pipes, and the effect is present in different pipe materials, including magnetically soft ferromagnetic and paramagnetic alloys (e.g. steel, carbon steel, Monel and aluminum), which makes the method applicable to any drill strings and casing strings, with the exception of "exotic" cases of glass-fiber-reinforced plastic strings.

In the most preferable embodiment, the method is implemented as follows:

1. Cable blocks are located on the derrick in the same way as during the measurements taken by using the method of magnetic marks, described above.
2. The apparatus of the present invention is lowered to the bottom of the pipe and the "first pass" is made to take measurements of the electromagnetic field decay along the full length of the pipe. The apparatus is moved along the hole and current pulses (200 msec) are sent to the exciting coil. Right after the current has been switched off, the time-induced electromagnetic field decay is recorded within 500 msec. So, time-induced electromagnetic field decay curves are recorded over equal intervals along the length of the pipe. The data are stored on a computer hard drive.
3. A stretching or twisting force is applied to the string by using the drilling rig mechanisms.
4. The apparatus of the present invention is lowered to the bottom of the pipe and the "second pass" is made to take measurements of the electromagnetic field decay along the full length of the pipe in the same way as described in paragraph 2 above. By comparing the resulting decay curves with the data which were previously recorded according to paragraph 2, drillers obtain the value of a relative variation of 1 along the string.

5. A conclusion about the stuck point is made as follows: μ does not change substantially below the stuck point ($\Delta\mu \approx 0$), but changes above the stuck point: the greater the force applied according to paragraph 3 above, the greater the change.

EXAMPLE

Figure 1:
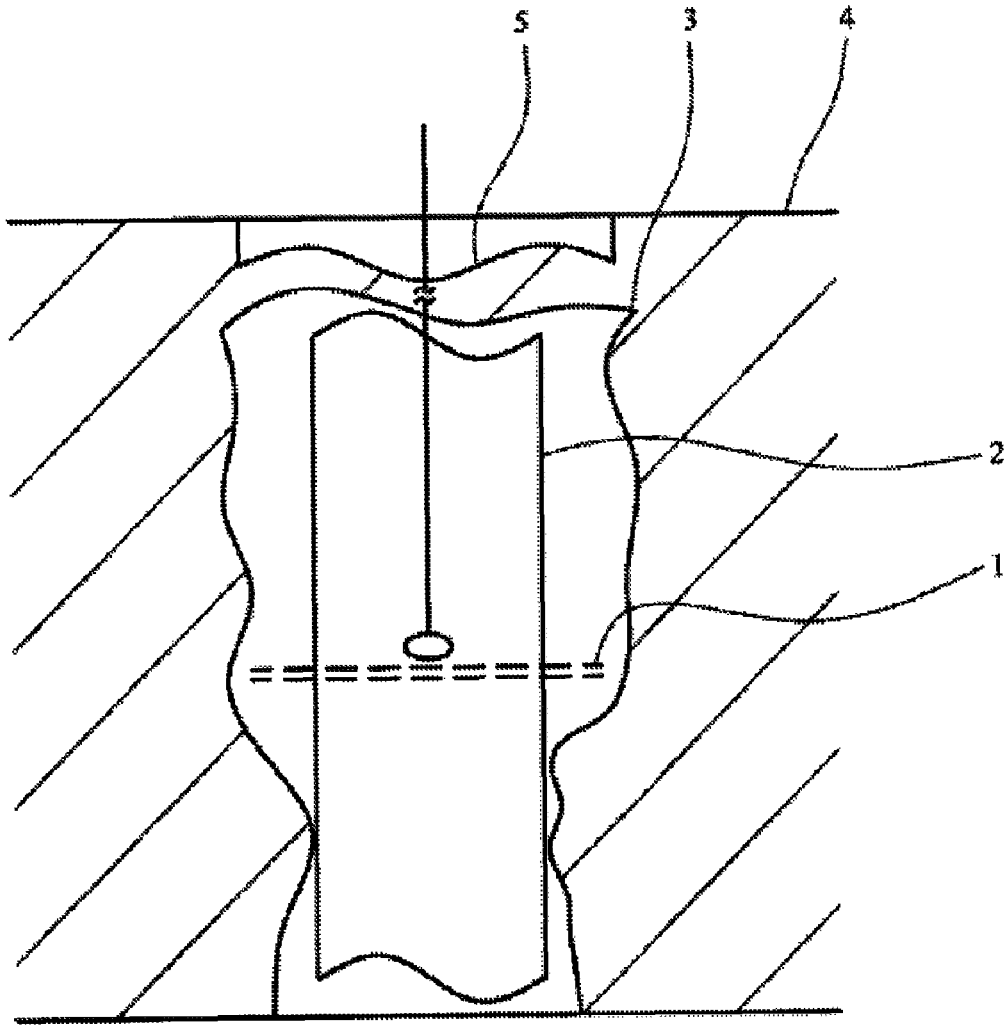
FIG. 1 is schematic illustration of a free or stuck point in a tubular of the present invention.
Figure 2:
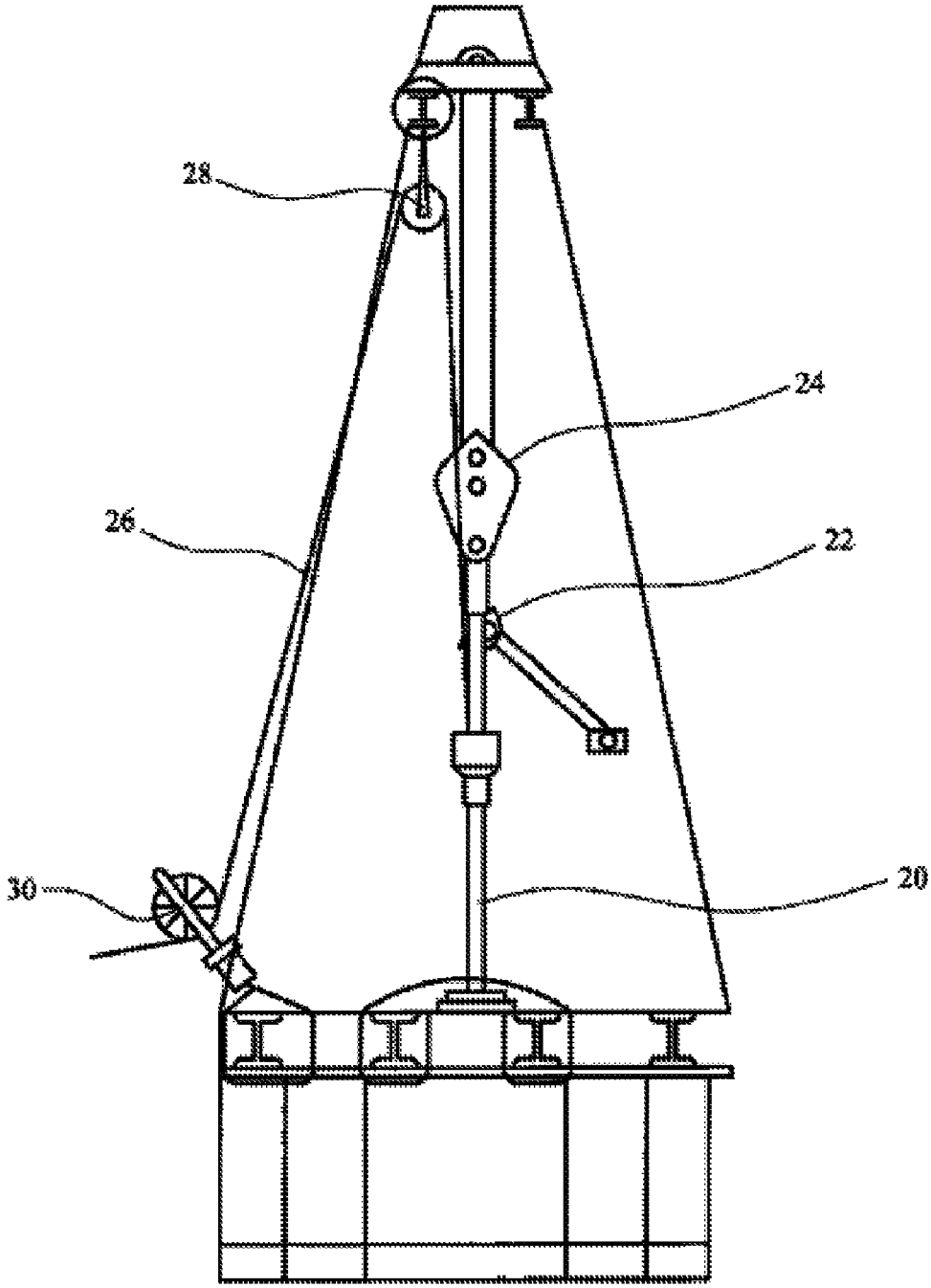
FIG. 2 illustrates a typical conventional rig-up of stretch/torque downhole sensor tool.
Figure 3:
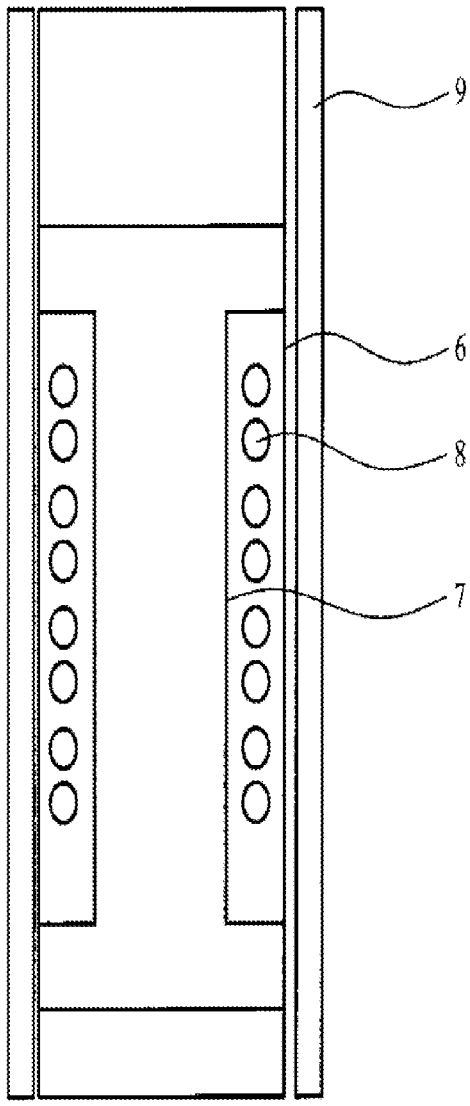
FIG. 3 is a free point tool based on magnetic marks determination of free point.

A specific example of implementation of the method of the present invention on a pilot unit, using a steel casing string 155 mm in diameter, is given below. The tool is run into the casing string in the same manner as is described above in relation to FIG. 2. The casing string is 1840 m long. After the first pass of the logging tool, the free point was determined at a depth of 1170 m from the surface. The pipe was loaded by being stretched, using a force equal to 0.95 of the ultimate mechanical strength. After the second pass of the logging tool, the free point was determined more precisely at a depth of 1158 m from the surface. Actually, the free point was at a depth of 1158.1 m.

The accuracy of the stuck point depth determination corresponds to the accuracy of the depth determination system of the logging tool used (i.e. ±0.15 m in the above example, assuming 0.15 m separation between logging stations).

Changes may be made while still remaining within the scope of the invention. For example, the tension described above to stretch the tubular may include torsion, either alone or in conjunction with stretching.

The invention claimed is:

1. A method of determining a free point in a stuck drill pipe, comprising the steps of:

a. measuring a first magnetic permeability (μ1) based on a time-induced decay of the electromagnetic field generated by application of an electric current pulse to the pipe in a first tension state (l0);

b. applying a force to the pipe to change the tension state of the pipe (l1);

c. measuring a second magnetic permeability (μ2) of the extended pipe in a second tension state (l1); and d. comparing the first and second magnetic permeabilities (μ1 and μ2) along the pipe to determine the free point based on the change of magnetic permeability.

2. A method according to claim 1, wherein the pipe is essentially unextended in the first tension state and is stretched in the second tension state.

3. A method according to claim 1, wherein the force is applied at the level of a derrick floor from which the drill pipe is suspended.

4. A method according to claim 1 comprising the additional step of using calculations based from Maxwell equations to determine the free point.

5. A method according to claim 1, wherein the force applied to the pipe is a tension force.

6. A method according to claim 1, wherein the force applied to the pipe is a torsion force.

7. A method as claimed in claim 1, comprising the additional step of making a series of magnetic permeability measurements at different locations within the drill pipe.

8. A method as claimed in claim 1, comprising the steps of:

applying a first electric current pulse to the pipe;

measuring the first magnetic permeability;

changing the tension state of the pipe;

applying a second electric current pulse to the pipe; and measuring the second magnetic permeability.

9. A method of using an apparatus comprising a diamagnetic shell containing a coaxially located exciting coil and two electromagnetic field measuring devices, wherein two coaxial coils are located on either side of the exciting coil to determine a free point in stuck drill pipes, the method comprising the steps of:

moving the apparatus through the drill pipes and measuring a first time-induced electromagnetic field decay along the length of the drill pipes;

applying a force to the drill pipes;

moving the apparatus through the drill pipes and measuring a second time-induced electromagnetic field decay along the length of the drill pipes; and determining the free point by comparing the first and second respective time-induced electromagnetic field decays to obtain a relative variation of magnetic permeability along the drill pipes.

10. A method according to claim 9, wherein the free point is obtained by determining a point below which the magnetic permeability does not substantially change when the force is applied to the drill pipes and above which the magnetic permeability changes when the force is applied to the drill pipes.

11. A method according to claim 9, comprising the additional step of creating a short square pulse of electric current in the exciting coil when measuring electromagnetic field decay.

12. A method as claimed in claim 11, wherein the duration of the pulse is about 100 to about 300 msec.

13. A method as claimed in claim 12, wherein the drill pipes are a drill string or casing string.

* * * * *